United States Patent [19]

Davies

[11] Patent Number: 4,984,402

[45] Date of Patent: Jan. 15, 1991

[54] SASH WINDOW ARRANGEMENT

[75] Inventor: Lawrence W. Davies, Winnipeg, Canada

[73] Assignee: Omniglass Ltd., Winnipeg, Canada

[21] Appl. No.: 414,008

[22] Filed: Sep. 29, 1989

[51] Int. Cl.[5] ..... E04B 1/66; E04B 1/70

[52] U.S. Cl. ..... 52/398; 52/303

[58] Field of Search ..... 52/398, 387, 302, 303, 52/399; 49/380, 388

[56] References Cited

U.S. PATENT DOCUMENTS

| | | | |
|---|---|---|---|
| 2,021,179 | 11/1935 | Fox | 52/398 |
| 3,105,274 | 10/1963 | Armstrong | 52/398 |
| 3,866,374 | 2/1975 | Dallen | 52/398 X |
| 3,894,371 | 7/1975 | Yamaha | 49/476 X |
| 4,003,171 | 1/1977 | Mitchell | 49/476 X |
| 4,064,653 | 12/1977 | Randall | 49/458 |
| 4,104,829 | 8/1978 | Agcaoili | 49/425 X |
| 4,154,033 | 5/1979 | Krueger | 52/773 X |
| 4,219,971 | 9/1980 | Mauroner | 49/425 |
| 4,392,330 | 7/1983 | Buhr | 49/388 X |
| 4,551,364 | 11/1985 | Davies | 52/476 X |
| 4,564,540 | 1/1986 | Davies | 52/172 X |
| 4,652,472 | 3/1987 | Davies | 52/456 X |
| 4,669,241 | 6/1987 | Kelly | 52/398 X |
| 4,691,477 | 9/1987 | Governale | 49/380 |
| 4,742,647 | 5/1988 | Pacca | 49/380 X |
| 4,785,581 | 11/1988 | Abramson | 49/388 X |

FOREIGN PATENT DOCUMENTS

| | | | |
|---|---|---|---|
| 900766 | 7/1962 | United Kingdom | 52/398 |

*Primary Examiner*—Richard E. Chilcot, Jr.
*Assistant Examiner*—Deborah McGann Ripley
*Attorney, Agent, or Firm*—Adrian D. Battison; Stanley G. Ade; Murray E. Thrift

[57] ABSTRACT

A sash window is formed from a frame profile and a sealed window unit comprising a pair of spaced parallel glass panes. The frame profile includes a channel section with a tranverse web and upstanding side walls which are formed integrally without separate stops and integrally with a support element for the window frame. The frame profile is manufactured by pultrusion to provide a coefficient of expansion very close to that of glass. The sealed window unit is sealed to the window frame by a bead of sealant material only at the corner between the inner face of the window unit and the tranverse web supporting the side edge of the window unit. The sealant is thus protected from exposure to the elements. A drainage opening is provided in the web to allow the escape of moisture passing between the direct contact between the outer side wall and the outer face of the window unit.

7 Claims, 1 Drawing Sheet

SASH WINDOW ARRANGEMENT

BACKGROUND OF THE INVENTION

This invention relates to a sash window arrangement and particularly to a construction of sash window including frame profiles and a sealed window unit which has a simplified construction in relation to the sealing material which prevents air and moisture penetration between the profile and the outer edge of the window unit.

Conventionally a sealed window unit comprises at least two panes of glass which are separated by a spacer including a desiccant material. The spacer is suitably sealed to the inner faces of the glass sheets and then the outer edge of the window unit is completed by a tape or similar material. In this way penetration of moisture or air into the space between the glass sheets is prevented. The window unit is then seated into four separate lengths of frame profile which are connected into a rectangular frame surrounding the window unit. In many cases the profile includes a channel with a transverse web contacting the outer edge of the window unit and a pair of upstanding sides which confine the window unit.

Between the profile and the window unit it is necessary to provide a suitable bedding and sealing material so that the window unit is generally relatively loose fit within the profile and the space between the window unit and the profile is filled by rubber gaskets or other sealing material which is provided on the inner surface of the sides of the profile and generally projects upwardly beyond the top of the sides onto the face of the glass. In some cases this is provided by a separate gasket. In other cases it is provided by a bead of a sealant material. In all cases it is considered necessary to prevent the entry of air or moisture between the top edge of the side and the outer face of the glass sheet. This leaves an outer portion of the sealant material which is exposed to the environment and accordingly can crack and deteriorate.

SUMMARY OF THE INVENTION

It is one object of the present invention to provide an improved sash window arrangement which has sealing material between the sealed window unit and the window frame profile which is of a simplified construction and accordingly cheaper to manufacture.

It is a further object of the present invention to provide an improved sash window unit in which the sealing material between the window unit and the surrounding profile is received wholly inside the channel and accordingly is not exposed to environmental deterioration.

According to the invention, there is provided a sash window comprising window frame profile and a sealed window unit, the sealed window unit comprising two panes of glass and spacer means holding the panes in spaced parallel relationship, said spacer means including means preventing the entry of air into the space between the panes, the unit having at least one side edge, an inner face for facing inwardly into a building and an outer face for facing outwardly of the building to the exterior, the profile extending along said one side edge of the window unit so as to provide support therefor and comprising an integral unitary body defining in cross section a channel portion and a closed hollow support element for the channel portion, the channel portion having a first transverse web against which said one side edge of the window unit contacts and a first and a second side wall each upstanding from the web and contacting and confining respectively said outer and inner faces of the window unit adjacent said side edge, the support element being defined by said transverse web, an inner wall, an outer wall and a second transverse web substantially parallel to the first transverse web, the profile being manufactured from material such that the coefficient of thermal expansion of the profile in a longitudinal direction is substantially equal to that of glass, means for sealing the window unit in the channel portion against passage of air therebetween consisting solely of a bead of flexible sealant material in a corner of the channel portion between the second side wall contacting the inner face of the window unit and the web, said outer face of the window unit being directly in contact with the respective side so that the outer face of the window unit is free from exposed sealant material, means in the first transverse web defining at least one drainage opening for escape of water into the hollow support element and means in the hollow support element defining a drainage opening for escape of water therefrom.

With the foregoing in view, and other advantages as will become apparent to those skilled in the art to which this invention relates as this specification proceeds, the invention is herein described by reference to the accompanying drawings forming a part hereof, which includes a description of the best mode known to the application and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
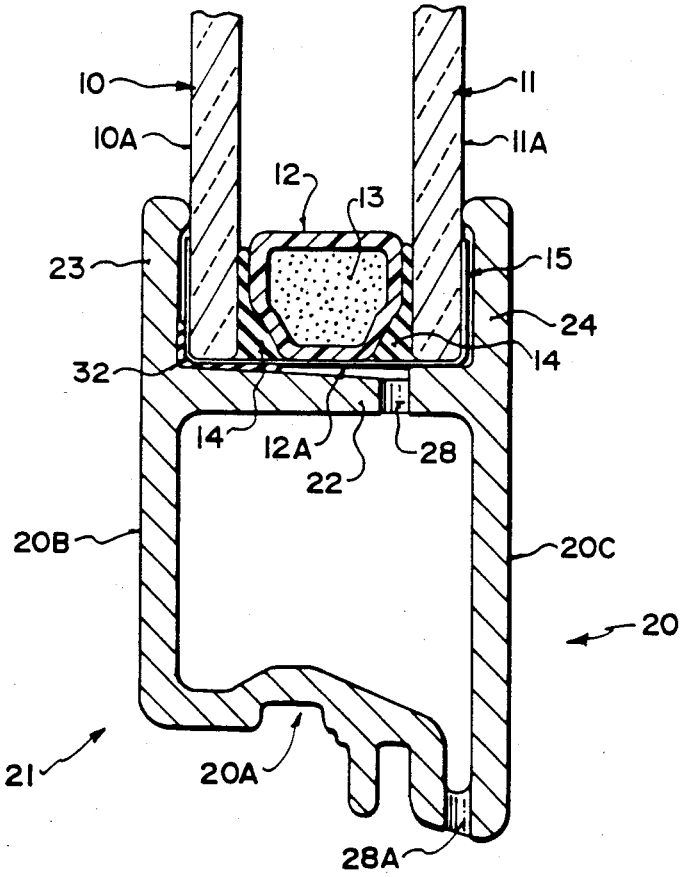
FIG. 1 is a cross-sectional view through a sash window including a sealed window unit and a surrounding window frame profile.

A conventional sealed window unit comprises a first inner sheet of glass 10 and a second outer sheet of glass 11. Between the sheets is a spacer 12 which includes a desiccant material 13 either received within the hollow spacer or embedded within a solid spacer. A sealant material 14 is positioned between the spacer and the inner surfaces of the glass to prevent the entry of air or moisture between the spacer and the glass. A tape 15 is in some cases wrapped around the edge and extends partly along the outer faces of the glass to unify the structure into a complete integral unit. The sealed unit this defines an inner face 10A for facing inwardly into a building in which the unit is mounted and an outer face 11A for facing outwardly toward the exterior, together with a side edge 12A.

A sash window frame is formed from four separate profiles cut to length and connected at corners by suitable technique (not shown). One of the profiles is shown in cross-section in FIGS. 1 and 2. The profile is formed by a pultrusion process which is a known technique using fibre material either in roving or mat form which passes through an elongate dye and carries with it a thermosetting resin thus forming a thermoset plastic part which is reinforced continuously in a longitudinal direction by the glass fibre material.

The use of a pultrusion technique using glass reinforcing fibres forms a part which has a coefficient of thermal expansion and contraction in a longitudinal direction which is substantially equal to that of glass and hence substantially equal to that of the glass sheets 10 and 11.

The profile is generally indicated at 20 and includes a supporting outer profile part 21 the shape of which is of no importance to the present invention but is shown in FIG. 1 for completeness. The important portion of the profile in relation to the present invention comprises the upper or inner part of the profile shown in FIGS. 1 and 2 which includes a first transverse web 22 on which the outer edge of the glass sits and upstanding side walls 23 and 24 which confine the inner and outer faces 10A and 11A respectively. The hollow outer part is defined by four sides which thus generate structurally rigid element for acting as the window frame. This includes a second transverse web 20A generally parallel to the web 22 and two sides 20B and 20C together forming a closed hollow structurally supporting profile. An inner face 25 of each of the sides includes a substantially flat part 25A which extends parallel to the outer face of the glass and an upper lip 26 which projects slightly inwardly so as to contact the glass and hold it away from direct contact with the portion 25A.

Figure 2:
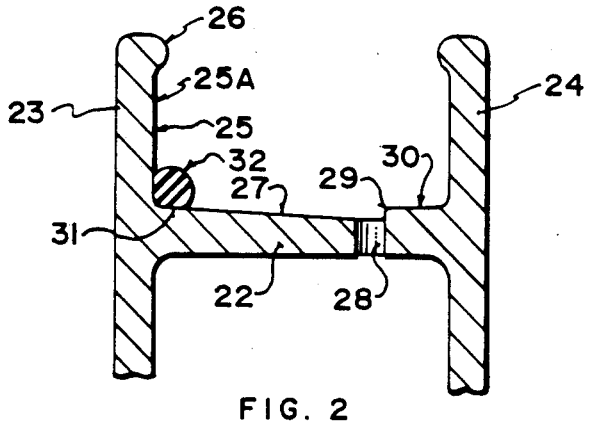
FIG. 2 is a similar cross-sectional view showing the profile only before the insertion of the sealed window unit.

As best shown in FIG. 2 the web lies generally at right angles to the sides 23 and 24 but an outer surface of the web is inclined as indicated at 27 downwardly toward a drilled hole 28 which acts as a drain hole at a lowermost point of the outer surface of the web. On the right hand side of the drain hole 28 is a step 29 so that the portion 30 of the upper surface of the web is at a substantially equal height to a portion 31 adjacent the side 23.

A bead 32 of a flexible (non-curing) sealant material such as Butyl is introduced into the profile at the corner between the inner surface 25 of the side and the upper surface of the web at the portion 31. This bead of sealant material is introduced in a manufacturing process of the sash window subsequent to the formation of the profile and the cutting of the profile into the required lengths and just before insertion of the sealed window unit. The amount of the sealant material 32 is such that even when compressed by the glass it does not extend up the surface 25 to the top or across the surface 27 to any significant extent. The sealant to prevent the passage of air 32 thus acts between the glass and the profile solely at the corner between the side and the web of the profile adjacent the inner sheet 10 of the glass. No other sealant material is used so that no sealing material or gasket is exposed to the environment at the top edge of the sides 23 and 24.

The height of the portion 31 is substantially equal to the height of the portion 30 of the upper surface of the web so that the glass sheets 10 and 11 can sit substantially directly upon those portions with effectively zero clearance that is a clearance of less than 0.060 inches. Such a small clearance is conventionally unacceptable in view of the differential in thermal expansion between the profile and the glass. It is also conventionally necessary to provide a seating or bedding material of a flexible nature to accommodate the relative shifting therebetween. In this case the properties of the profile are employed so that a very small clearance is used and no bedding material is required, the only sealant of a flexible nature being provided by the material 32. This also provides the advantage that the glass structure is used to help keep the sash square to prevent "sash sagging" which is a common problem in the trade.

The sealant material 32 can be injected as a bead into place from a gun or it can be provided as an elongate element which is inserted and then held in place by the pressing of the seal when used into the channel.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A sash window comprising: window frame profile and a sealed window unit, the sealed window unit comprising two panes of glass and spacer means holding the panes in spaced parallel relationship, said spacer means including means preventing an entry of air into the space between the panes; the unit having at least one side edge, an inner face for facing inwardly into a building and an outer face for facing outwardly of the building to an exterior; the profile extending along said one side edge of the window unit so as to provide support thereof and comprising an integral unitary body defining, in cross section, a channel portion and a closed hollow support element for the channel portion; the channel portion having a first transverse web against which said one side edge of the window unit contacts and a first and a second side wall each upstanding from the first transverse web and contacting and confining respectively said outer and inner faces of the window unit adjacent said side edge; the support element being defined by said transverse web, an inner wall, an outer wall and a second transverse web substantially parallel to the first transverse web; the profile being manufactured from material such that the coefficient of thermal expansion of the profile in a longitudinal direction is substantially equal to that of glass; means for sealing the window unit in the channel portion against passage of air therebetween consisting solely of a bead of flexible sealant material in a corner of the channel portion between the second side wall contacting the inner face of the window unit and the first transverse web; said outer face of the window unit being directly in contact with the respective side so that the outer face of the window unit is free from exposed sealant material; means in the first transverse web defining at least one drainage opening for escape of water into the hollow support element; and means in the second transverse web of said hollow support element defining a drainage opening for escape of water therefrom.

2. The invention according to claim 1 wherein the flexible sealant material is not exposed above a top edge of the side walls of the channel portion.

3. The invention according to claim 1 wherein the first transverse web includes a surface contacting said side edge of the window unit which inclines away from said side edge in a direction from adjacent said corner toward the drainage opening.

4. The invention according to claim 1 wherein the flexible sealant material is non-curing.

5. The invention according to claim 1 wherein the flexible sealant material is Butyl.

6. The invention according to claim 1 wherein the clearance between the said side edge of the sealed window unit and the adjacent surface of the first transverse web is less than 0.060 inches.

7. The invention according to claim 1 wherein the profile is manufactured by pultrusion from a thermosetting material reinforced by longitudinally extending glass fibre.

* * * * *